United States Patent [19]

Lange

[11] Patent Number: 4,780,646

[45] Date of Patent: Oct. 25, 1988

[54] HIGH PRESSURE DISCHARGE LAMP STRUCTURE

[75] Inventor: Horst Lange, Pullach, Fed. Rep. of Germany

[73] Assignee: Patent Treuhand Gesellschaft für elektrische Glühlampen mbH, Munich, Fed. Rep. of Germany

[21] Appl. No.: 108,418

[22] Filed: Oct. 14, 1987

[30] Foreign Application Priority Data

Oct. 23, 1986 [DE] Fed. Rep. of Germany ..... 3636110

[51] Int. Cl.[4] ..... H01J 17/18; H01J 61/36

[52] U.S. Cl. ..... 313/623; 313/625; 313/626; 313/332

[58] Field of Search ..... 313/623, 624, 625, 626, 313/631, 242, 332, 634

[56] References Cited

U.S. PATENT DOCUMENTS

| | | | |
|---|---|---|---|
| 3,531,853 | 10/1970 | Klomp | 313/623 X |
| 3,892,993 | 7/1975 | Timmermans | 313/626 X |
| 3,916,242 | 10/1975 | Wright, Jr. | 313/625 |
| 4,160,186 | 7/1979 | Kerekes | 313/623 X |

FOREIGN PATENT DOCUMENTS

| | | |
|---|---|---|
| 0074188 | 3/1983 | European Pat. Off. . |
| 0074720 | 3/1983 | European Pat. Off. . |

*Primary Examiner*—David K. Moore
*Assistant Examiner*—Michael Horabik
*Attorney, Agent, or Firm*—Frishauf, Holtz, Goodman & Woodward

[57] ABSTRACT

To provide an electrode connection lead (8) made of tungsten positioned on the inside of a high-pressure discharge lamp (1,2) which contains a fill attacking niobium, while providing for a melt connection including niobium to the discharge vessel, to permit use of aluminum oxide ceramic for the discharge vessel—since niobium and aluminum oxide ceramic have approximately the same thermal coefficient of expansion—the tubular discharge vessel is formed with an end portion defining an abutment (5), against which an internal aluminum oxide ceramic disk (4) is seated, defining a recess (**4*a*) within which a niobium sealing disk (6) is partly located. An identical external sealing disk (3) receives the remainder of the niobium sealing disk. An external current supply lead (7) of niobium is welded to the niobium sealing disk. The internal current supply lead (8) of tungsten, likewise, is welded to the niobium sealing disk. The internal and external disks (4,3), the sealing disk (6**) and the current supply leads are melted-into the aluminum oxide ceramic body by means of a glass melt connection utilizing a melt glass not attacked by fill substances used in metal halide lamps.

19 Claims, 1 Drawing Sheet

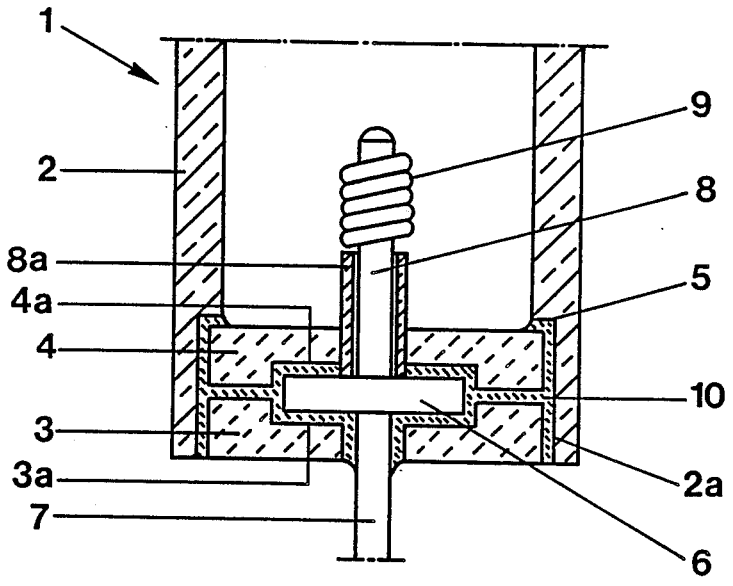
1
2
8a
4a
4
3
3a
7
9
8
5
10
2a
6

HIGH PRESSURE DISCHARGE LAMP STRUCTURE

REFERENCE TO RELATED DISCLOSURES

Published European Patent Specification No. 0074188, Denbigh et al.;

Published European Patent Specification No. 0074720, Coaton et al.

The present invention relates to high-pressure lamps and more particularly to a construction of a high-pressure discharge lamp having a bulb operable at extremely high temperatures, and in which the current supply connection is melted into an end portion of the discharge vessel or bulb.

BACKGROUND

In metal halide high-pressure lamps having discharge vessels of quartz glass, not all optically active fill substances can be vaporized at operating temperature, so that some proportion thereof remains as a condensate within the discharge vessel, without participating in the discharge formation. The quartz glass, which can withstand the temperature only slightly above 1000° C., provides an upper limit for the operating temperature. Quartz glass, further, is attacked by the highly aggressive fill substances used in metal halide high-pressure discharge lamps and becomes brittle due to recrystallization. This negatively affects the life of the lamp.

It has been proposed to utilize aluminum oxide ceramic as the bulb or arc vessel for a metal halide high-pressure lamp. Aluminum oxide ceramic is well known from the technology of sodium high-pressure lamps. This material is capable of withstanding a temperature of up to about 1300° C., and is not attacked by the aggressive substances of the fill. Aluminum oxide ceramic, however, introduces a difficulty in the manufacture of a gas-tight, pressure-tight melt for the electrodes. Tungsten, which is customarily used for the current supplies, has a higher thermal coefficient of expansion than aluminum oxide ceramic. At the high temperatures which occur, the current supply lead made of tungsten would destroy the melt connection through the discharge vessel, if made of aluminum oxide ceramic.

It has been proposed to utilize current supply leads made of niobium rather than of tungsten. The thermal coefficient of expansion of nobium corresponds roughly to that of aluminum oxide ceramic, and the melt connection is not destroyed thereby. Niobium, however, has the disadvantage that it is attacked by the aggressive fill substances of the metal halides and thus the presence of niobium within the discharge vessel cannot be tolerated.

European published patent specification EP No. 0 074 188 describes a melt connection for a sodium high-pressure lamp in which the discharge vessel is made of aluminum oxide ceramic and a terminal connection for current supply of niobium is used. A current connecting lead of tungsten is welded to the niobium lead, the tungsten connection carrying the electrode. Melt connections with terminals made of Cermet are also proposed.

European published patent-specification EP NO. 0 074 720, assigned to the same assignee as the aforementioned EP 0 074 188, describes a further development in which the application of the current supply connection is extended to high-pressure discharge lamps with metal halide filling.

It has been found that the presence of even a portion of the niobium through-connection within the interior of the discharge vessel leads to deterioration thereof and premature failure of the lamp.

THE INVENTION

It is an object to provide a melt connection for a high-pressure discharge lamp vessel construction, and more particularly a melt connection, in which the bulb or discharge vessel is made of aluminum oxide ceramic, which is gas-tight, is not subject to premature failure due to deterioration of the melt connection, and which may be used for sodium and metal halide discharge lamps alike.

Briefly, a niobium melt connection is used. The niobium is isolated, however, from the interior of the lamp by constructing the niobium in form of a sealing disk embedded between an internal and an external disk of the aluminum ceramic. The side of the sealing disk facing the outside has a niobium electrode lead secured thereto, for example by welding, and the side of the niobium disk facing the inside has a tungsten electrode secured thereto, for example by welding. The two ceramic sealing disks are retained in the ceramic bulb or discharge vessel by a suitable glass melt, which has a well-known composition resistant to the aggressive fill substances within the lamp, and filling any capillary spaces between the ceramic disks and the aluminum oxide of the discharge vessel or bulb.

The arrangement has the advantage that the melt connection is gas- and pressure-tight and is suitable for sodium high-pressure discharge lamps, as well as for metal halide high-pressure discharge lamps. No niobium is present within the discharge space itself, which might be attacked by aggressive fill substances within the discharge vessel, and particularly such aggressive fill substances used in metal halide discharge lamps, thus substantially increasing the lifetime of the lamp.

The discharge vessel is highly temperature loaded, and thus complete vaporization of all fill components can be obtained, so that all optically active fill components will be fully effective and vaporized. This improves the color rendition characteristics of the lamps with respect to those of the prior art.

The melt connection between an inner disk and an outer disk, both of aluminum oxide ceramic, and embedding the sealing disk of niobium, further insures connection which is essentially free of stresses, and thus tightness throughout a wide temperature range and including the extreme operating temperature which the aluminum oxide ceramic can accept. This further increases the lifetime of the lamp.

DRAWINGS

The single figure is a schematic cross-section of a melt-through connection of an electrode suitable for a sodium or metal halide high-pressure discharge lamp.

DETAILED DESCRIPTION

A discharge vessel 1, of standard construction and, for example in the form of an elongated tube 2, is made of aluminum oxide ceramic. Only one end portion of the discharge vessel is shown; the other end portion and electrode can be identical. The tube 2 is closed off at the bottom by a closing structure. The closing structure is formed by an external disk 3 and a preferably identical inner disk 4. Disks 3,4 are made of aluminum oxide ceramic. The disks 3,4 are positioned tightly against each other. The tubular body 2 is formed with a shoulder 5 and a recess in the inner diameter thereof to accept the two disks 3,4; the position of the shoulder 5 corresponds approximately to the thickness of the two disks 3,4 taken together.

The tubular body 2, the external disk 3 and the internal disk 4 all are of aluminum oxide ceramic.

A sealing disk 6 of niobium is embedded between the disks 3,4. The diameter of the disk 6 is less than the diameter of the disks 3,4. The disks 3,4 are formed with recesses 3a,4a to receive the disk 6—see the figure. The recesses 3a,4a in the disks 3,4 have a depth of about half the thickness of the niobium disk 6. An external current supply lead 7 is secured to the disk 6. Lead 7 is made of niobium and, for example, welded to the disk 6. An internal current supply lead 8 is connected to the niobium disk 6. Internal current supply lead 8 is made of tungsten and, for example, welded to the niobium disk 6. The respective disks 3,4 are formed with concentric openings for the respective current supply leads 7,8. Electrically conductive welding connections are suitable for attaching the supply leads 7,8 to the disk 6. A coiled electrode 9 of tungsten is secured to the internal current supply lead 8, located within the discharge space of the discharge vessel 1, and, for example, of standard construction. The entire end connection of the discharge vessel 1 is closed off gas- and pressure-tight by means of a metal halide resistant glass melt of solder 10, filling the capillary spaces between the recessed tubular portion 2a of the discharge vessel 2, the external and internal disks 3,4, the space around the recesses 3a,4a and a space around the electrode supply leads 7,8. These spaces, actually, are capillary spaces and are shown in the drawing greatly enlarged and exaggerated for ease of illustration. A tube 8a of aluminum oxide ceramic surrounds the tungsten current supply lead 8. The aluminum oxide ceramic tube 8a extends between the electrode winding or wrapping 9, also of tungsten, and the niobium disk 6. The tube 8a has a slightly larger internal diameter than the lead 8. The play or gap is just large enough to accomodate the different expansions of the tungsten lead 8 and the tube 8a; this gap is too small, however, that condensate of the fill components within the vessel 1 can deposit or precipitate therein. The absolute width of the play or gap depends on the diameter of the current supply 8 which, again, varies with the power rating of the lamp. The end of the tube 8a which faces the niobium disk 6 is tightly surrounded by the glass melt, made of solder glass 10. The solder glass 10 is resistant to metal halides.

Thermal coefficients of expansions, for typical elements used in the lamp are as follows:

tungsten: $45\times10^{-7}$ solder glass 10: $85\text{–}100\times10^{-7}$; melting point between about 1250° C. to 1370° C.

aluminum oxide ceramic, used for sealing disks 3, 4, and tube 8a: about $86\text{–}100\times10^{-7}$ niobium: about $85\times10^{-7}$ The construction, thus effectively avoids direct contact of the tungsten lead 8 with a material having a substantially different thermal coefficient of expansion. The sealing disk of niobium is effectively shielded from contact with the fill materials within the discharge vessel, so that the niobium disk is effectively protected against attack by the fill components therein, and especially the metal halides within the fill.

OPERATION

The thermal coefficient of expansion of niobium, as well known and as recited above, is close to that of aluminum oxide ceramic. Consequently, thermal stresses which occur during operation of the lamp, and particularly when the melt connection reaches an operating temperature which, typically, is about 800° C. and with an operating temperature of the discharge vessel which may go higher and be even in excess of 1000° C., can be essentially ignored. Preferably, the external surface of the aluminium oxide ceramic disk 3 terminates essentially flush with the bottom of the recessed portion 2a of the tube 2.

The arrangement permits use of metal halide high-pressure lamps with fill substances which would attack niobium. Such lamps have superior color rendition with respect to sodium high-pressure lamps.

I claim:

1. A high-pressure discharge lamp having a tubular discharge vessel (1) of aluminum oxide ceramic;

a tungsten electrode (9) located within the discharge vessel;

a tungsten internal electrode connection lead (8) extending into the discharge vessel (1) and supporting the electrode (9);

a niobium external connection lead (7) extending outside of the discharge vessel (1), and a sealing connection arrangement, closing the tubular discharge vessel, to connect said niobium external lead (7) and said tungsten internal connection lead (8), comprising, in accordance with the invention, means for isolating the niobium external connection lead (7) from the inside of the discharge vessel while sealing the niobium external connection lead through the discharge vessel, to provide a seal in which the respective materials of the niobium electrode and aluminum oxide ceramic of the discharge vessel have about the same thermal coefficient of expansion, said isolating means comprising an internal disk (4) of insulating material having a thermal coefficient of expansion at least approximately matching that of the aluminum oxide ceramic of the discharge vessel (1), said internal disk (4) having a first face surface directed toward the inside of the discharge vessel and a second face surface directed toward the outside thereof;

an external disk (3) of insulating material having a thermal coefficient of expansion at least approximately matching that of the aluminum oxide ceramic of the discharge vessel (1), said external disk (4) having a first face surface directed toward the outside of the discharge vessel and a second face surface directed toward the inside thereof;

a sealing disk (6) having two opposite surfaces, said sealing disk comprising niobium and being embedded between said internal disk (4) and external disk (3) and located against said second face surfaces thereof, and wherein the tungsten internal electrode lead (8) is secured to said sealing disk at the side facing the inside of the discharge vessel, and the niobium external electrode lead (7) is secured to said sealing disk at the side facing the outside of the discharge vessel.

2. The lamp of claim 1, wherein said internal disk and external disk, each, comprise aluminum oxide ceramic.

3. The lamp of claim 1, wherein the internal and external disks comprise the same aluminum oxide ceramic material as the material of the tubular discharge vessel.

4. The lamp of claim 1, wherein the said internal disk and said external disk (4, 3) have the same diameter and the same thickness.

5. The lamp of claim 4, wherein the internal and external disks are formed with a recess having, each, about half the thickness of said niobium sealing disk (6).

6. The lamp of claim 4, wherein the niobium sealing disk (6) has a smaller diameter than the internal and external disks (4,3).

7. The lamp of claim 6, wherein the internal and external disks (4,3) are formed with a recess having, each, about half the thickness of said niobium sealing disk (6), said recesses having diameters dimensioned to receive said niobium sealing disk and embed said niobium sealing disk therein.

8. The lamp of claim 7, wherein the discharge vessel comprises a tubular body (3) of essentially circular cross-section;

the internal and external disks (4,3) are essentially circular disks and formed with central apertures to receive said internal and external connection leads (8,9), and the recesses in said internal and external disks are concentric with respect to a center of the internal and external circular disks.

9. The lamp of claim 8, wherein the tubular ceramic body of the discharge vessel is formed with an end recess (2*a*) of enlarged internal diameter, and said end recess, at the transition to the portion of the discharge vessel defines a shoulder or abutment (5); and wherein the internal disk (4) is seated with its first face surface against said abutment.

10. The lamp of claim 9, wherein the tubular discharge vessel and the first face surface of the external disk (3) are in essential planar alignment to define a single termination plane of the tubular body (2) and the outer surface of the external disk.

11. The lamp of claim 2, further including a melt glass (10) sealing the internal disk, external disk, and niobium sealing disk to the tubular discharge vessel.

12. The lamp of claim 7, further including a melt glass (10) sealing the internal disk, external disk, and niobium sealing disk to the tubular discharge vessel.

13. The lamp of claim 8, further including a melt glass (10) sealing the internal disk, external disk, and niobium sealing disk to the tubular discharge vessel.

14. The lamp of claim 9, further including a melt glass (10) sealing the internal disk, external disk, and niobium sealing disk to the tubular discharge vessel.

15. The lamp of claim 1, further including a ceramic tube (8*a*) surrounding said internal electrode connection lead and extending up to said niobium sealing disk (6).

16. The lamp of claim 15, further including a melt glass (10) sealing the internal disk, external disk, and the niobium sealing disk to the tubular discharge vessel, and sealing said ceramic tube (8*a*) to said internal disk (4).

17. The lamp of claim 15, wherein the ceramic tube (8*a*) surrounds said internal connection lead with a slight clearance, just enough to permit expansion of said internal tungsten lead (8) upon heating of the lamp during operation.

18. The lamp of claim 15, wherein said ceramic tube extends from below said tungsten electrode to said sealing disk (6).

19. The lamp of claim 15, wherein said internal disk (4), said external disk (3) and said tube (8*a*), each, comprise aluminum oxide ceramic

* * * * *